US007188746B2

(12) United States Patent
Zethoff et al.

(10) Patent No.: US 7,188,746 B2
(45) **Date of Patent: *Mar. 13, 2007**

(54) CONTAINER CLOSURE ARRANGEMENT

(75) Inventors: Martin Zethoff, Kelkheim (DE); Thomas Radtke, Oberursel (DE); Kenneth Young, Königstein (DE); Bernard Sams, London (GB); Stephen Sams, London (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/166,467

(22) Filed: Jun. 24, 2005

(65) Prior Publication Data

US 2005/0236412 A1 Oct. 27, 2005

Related U.S. Application Data

(63) Continuation of application No. 10/339,248, filed on Jan. 9, 2003, now Pat. No. 6,942,118, which is a continuation of application No. PCT/US01/25222, filed on Aug. 10, 2001.

(51) Int. Cl.
*B65D 51/04* (2006.01)

(52) U.S. Cl. ..... 220/254.5; 220/264; 220/829; 220/835; 220/827

(58) Field of Classification Search ..... 220/254.3, 220/254.5, 264, 827, 829, 835
See application file for complete search history.

(56) References Cited

U.S. PATENT DOCUMENTS

| | | | | |
|---|---|---|---|---|
| 2,295,494 | A | 9/1942 | Valentine | |
| 2,303,147 | A | 11/1942 | Tinnerman | |
| 2,435,272 | A | 2/1948 | Graham | |
| 2,580,310 | A | 12/1951 | Magnenat | |
| 2,634,018 | A | 4/1953 | Mageau, Jr. | |
| 2,702,651 | A | 2/1955 | Graham | |
| 2,708,508 | A | 5/1955 | Marsh | |
| 2,905,356 | A | 9/1959 | Jerome | |
| 2,984,380 | A | 5/1961 | Leopold et al. | |
| 3,297,192 | A | 1/1967 | Swett | |
| 4,184,603 | A | 1/1980 | Hamilton, Sr. | |
| 4,739,900 | A * | 4/1988 | Borst | 220/835 |
| 4,984,706 | A | 1/1991 | Cadwell et al. | |
| 5,573,132 | A * | 11/1996 | Kanfer et al. | 220/4.23 |
| 5,699,912 | A | 12/1997 | Ishikawa et al. | |
| 5,893,481 | A | 4/1999 | Favre | |
| 6,065,626 | A | 5/2000 | Huang et al. | |
| 6,076,869 | A | 6/2000 | Chen et al. | |
| 6,206,221 | B1 | 3/2001 | Bando et al. | |

(Continued)

FOREIGN PATENT DOCUMENTS

DE 195 17 102 A1 11/1996

(Continued)

*Primary Examiner*—Anthony D. Stashick
*Assistant Examiner*—James Smalley
(74) *Attorney, Agent, or Firm*—Matthew P. Fitzpatrick; Charles R. Ware; Ken K. Patel

(57) ABSTRACT

This invention relates to a closure arrangement for closing an opening in a base component. In particular—but not exclusively—this invention relates to a closure arrangement for a container, to serve as an openable lid for the container.

3 Claims, 4 Drawing Sheets

U.S. PATENT DOCUMENTS

| | | | | |
|---|---|---|---|---|
| 6,394,298 | B1 | 5/2002 | Zaidman | |
| 6,530,498 | B1 | 3/2003 | Ovadia | |
| 6,574,834 | B2 | 6/2003 | Fedon | |
| 6,902,077 | B1 * | 6/2005 | Tack et al. | 220/259.1 |
| 2002/0017522 | A1 | 2/2002 | Bando et al. | |

FOREIGN PATENT DOCUMENTS

| | | | |
|---|---|---|---|
| EP | 0 608 757 | A1 | 8/1994 |
| EP | 0 953 313 | A1 | 11/1999 |
| WO | WO 99/12823 | A1 | 3/1999 |

* cited by examiner

CONTAINER CLOSURE ARRANGEMENT

CROSS REFERENCE TO RELATED APPLICATIONS

This application is a continuation of U.S. application Ser. No. 10/339,248, filed Jan. 9, 2003 now U.S. Pat. No. 6,942,118 which is a continuation of PCT International Application Serial No. PCT/US01/25222, filed Aug. 10, 2001.

FIELD OF INVENTION

This invention relates to a closure arrangement for closing an opening in a base component. In particular—but not exclusively—this invention relates to a closure arrangement for a container, to serve as an openable lid for the container.

BACKGROUND OF THE INVENTION

Many household products are supplied in a container having an opening to give access to the interior of the container, together with a lid to close that opening. Many such containers require two hands to remove the lid but for some products, it is desirable that the container can be opened simply, just with one hand. For example, in the case of a container for wetted or moist tissues, a person wishing to use a tissue may well have soiled fingers and so will wish to gain access to the interior of the container holding the tissues in a quick and simple manner. On the other hand, the lid for the container, when closed, should substantially seal the container so as to prevent drying-out of the wetted tissues.

Particularly in the case of a container for wetted tissues, it is advantageous if the lid can be moved from its closed position to its opened position automatically, on being released by a simple one-touch action by a finger of a user. For example, such a container is described in EP-0952088-A.

It is an aim of the present invention to improve on the several known designs of closure arrangements for containers and so provide such an arrangement which can be operated effectively and reliably for the expected life of the container, and yet which is cheap and easy to manufacture, bearing in mind that the container will probably be thrown away when its contents have been exhausted.

SUMMARY OF THE INVENTION

Accordingly, the present invention provides a closure arrangement comprising a base component defining a closable opening, a closure for the opening and hinged to the base component for movement between closed and open positions, juxtaposed lugs provided respectively on the base component and the closure in the region of the hinging axis of the closure, each lug having at or adjacent its free end a receptor, and an elastic link located in and extending between the receptors of the lugs, the receptors of the lugs being off-set from the hinging axis and arranged such that the link is strained when the closure is at its closed position, the straining of the link varying as the closure is moved between its closed and open positions and is least when the closure is at its open position.

It will be appreciated that the closure arrangement of this invention may be manufactured by a moulding operation using suitable plastics materials, except perhaps for the elastic link. Both the base component and the closure may be configured to be relatively simple items so as to be cheap to manufacture in large quantities and yet able to give reliable operation when in use.

Though it would be possible for there to be only one lug on the base component and only one lug on the closure, preferred embodiments of this invention have a single lug on one of the base component and the closure and on the other of the base component and closure a pair of spaced apart lugs so that the single lug is disposed therebetween. For such an arrangement, the elastic link may be strained between the pair of lugs and be deflected from a straight-line path by means of the single lug engaged substantially centrally with the link.

The elastic link preferably takes the form of a strip of elastomeric material moulded to have an enlarged head at each of its two ends respectively and which heads in use engage the respective lugs. Preferably, the strip of elastomeric material is of substantially circular cross-sectional shape. Each receptor may comprise a generally U-shaped recess formed in an end portion of each lug, which recess has a sufficient width to receive the strip of elastomeric material but the head of the strip serving to prevent the strip pulling out of the receptor transverse to the plane of the lug.

Preferably, a catch mechanism is provided to maintain the closure in its closed position, against the action of the strained link. Such a catch mechanism may comprise a catch member hinged to the base component and a tab provided on the closure which tab is engageable with the catch member so as to retain the closure in its closed position. Hinging of the catch member away from the tab will then release the closure to permit it to move to its open position, under the action of the elastic link. Such a releasing action may easily be performed by a single finger of a user so facilitating easy access to the contents of a container associated with the closure arrangement.

In an alternative embodiment, the arrangement of the lugs respectively on the base component and the closure is such that the straining of the elastic link initially increases on moving the closure from its closed position to its open position, before reducing to its smallest value with the closure at its open position. Such a closure arrangement will have an over-centre feel but may still be released easily so as automatically to move to its open position, merely by lifting the closure slightly.

Preferably, the closure arrangement of this invention is used in association with a container, the base component forming a part of a lid assembly for that container. Such a container may hold wetted or moistened sheets or tissues removable from the container through the opening in the base component. In this case, the closure when in its closed position may effect a generally air-tight seal to the base component, to minimise any drying of the moistened or wetted sheets within the container.

BRIEF DESCRIPTION OF THE DRAWINGS

By way of example, certain specific embodiments of this invention will now be described in detail, reference being made to the accompanying drawings in which:—

DETAILED DESCRIPTION OF THE INVENTION

Figure 1:
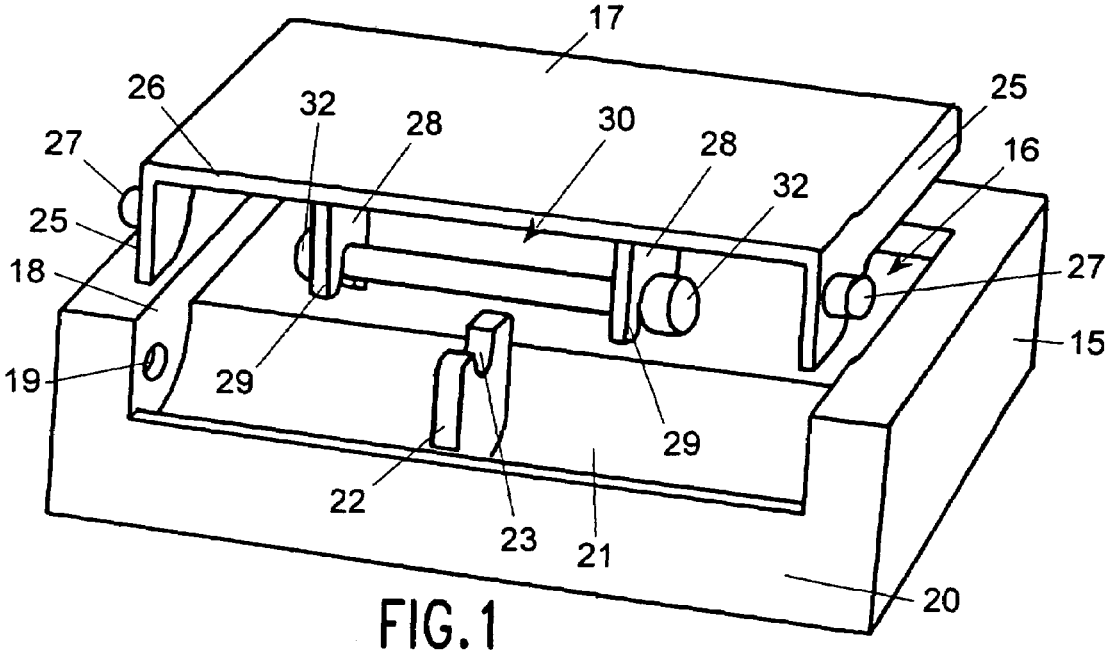
FIG. 1 is an isometric rear view of a first closure arrangement, with the closure separated from the base component.
Figure 2:
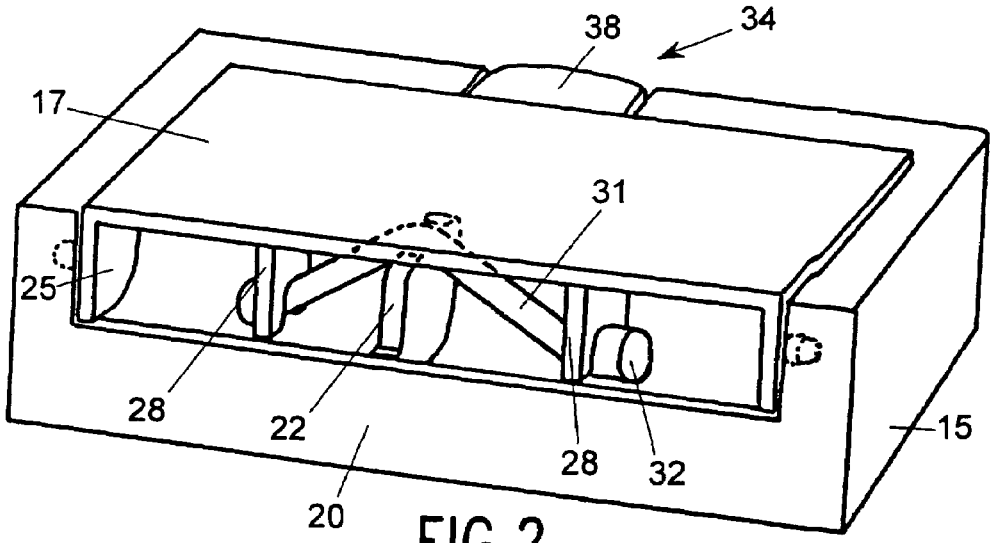
FIG. 2 is a view similar to that of FIG. 1 but with the closure fitted to the base component.
Figure 3:
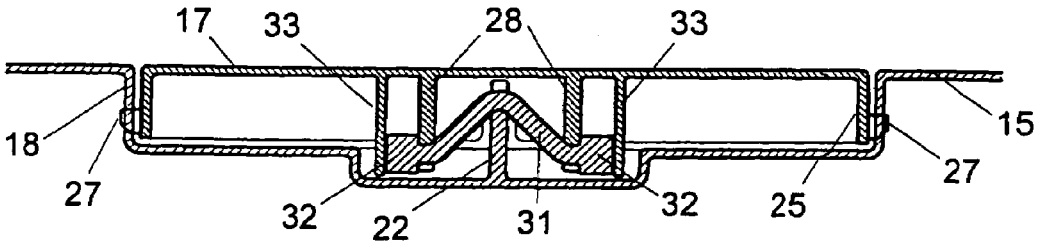
FIG. 3 is a sectional view through the arrangement of FIGS. 1 and 2 taken generally on the hinging axis of the closure.

Referring initially to FIGS. 1 to 3, there is shown a first embodiment of closure arrangement of this invention and comprising a base component 15 defining an opening 16, and a closure 17 pivoted to the base component 15 for movement between an open position and a closed position (shown in FIG. 2) where the closure closes the opening 16. Both the base component 15 and the closure 17 are moulded from a plastics material. The lower region of the base component 15 may be configured for mounting on a lid of a container, over an aperture through that lid. In the alternative, the base component 15 may itself form the lid for a container with which the closure arrangement is to be associated. Yet another possibility would be for the base component 15 to be formed integrally with or attached directly to a container.

Around three sides of the opening 16, the base component 15 is provided with an in-turned flange 18, that flange on the two sides having aligned holes 19, adjacent the rear wall 20 of the base component 15. A curved wall 21 extends inwardly of the opening 16 from the rear wall 20, curving upwardly towards the top face of the base component 15. A lug 22 projects upwardly from this curved wall 21, midway along the length of the rear wall 20, the lug 22 having a U-shaped slot 23 at its upper free end.

Figure 9A:
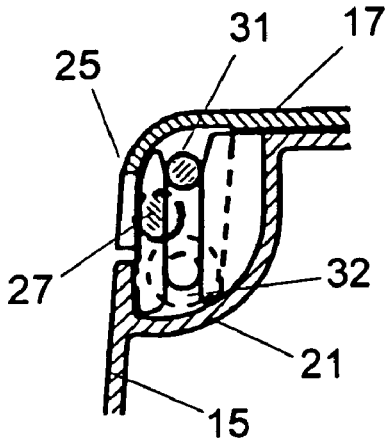
FIGS. 9A, 9B and 9C are cross-sections through the hinge region of the embodiment of FIGS. 1 to 3.
Figure 9B:
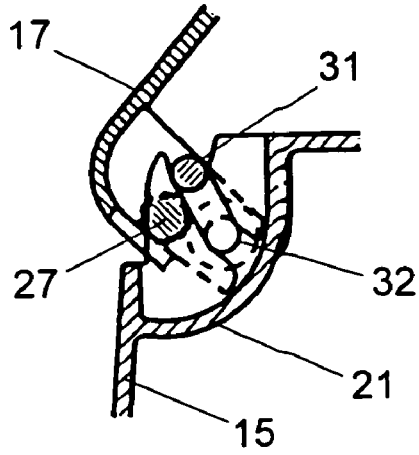
Figure 9C:
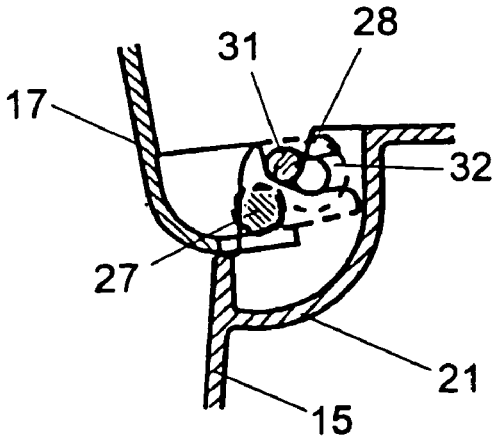

The closure 17 is of simple rectangular shape and is provided with a down-turned lip 25 around its periphery. For the sake of clarity, the lip has been omitted from the rear edge 26 of the closure in FIGS. 1 and 2, but is shown in FIGS. 9A, 9B and 9C, and has a curved form for interaction with the rear wall as the closure is opened. The closure 17 is dimensioned so that it is a snug fit within the opening 16 of the base component 15, when in its closed position shown in FIG. 2, giving a generally moisture-tight seal.

Projecting outwardly from the lip 25 at two opposed locations adjacent the rear edge 26 of the closure 17 are aligned pivot pins 27, arranged to be received in the aligned holes 19 of the base component 15, so allowing the closure 17 to pivot between the closed position shown in FIG. 2 to an open position shown in FIG. 9C. The under-surface of the closure 17 is provided with a pair of spaced lugs 28, disposed equidistant from the side edges of the closure and each having a U-shaped slot 29 formed in its free end. Stretched between the lugs 28 is a link 30 of an elastomeric material (such as natural or synthetic rubber), the link 30 having a main portion 31 of circular cross-sectional shape and a respective head 32 formed at each of the two ends of the main portion 31. As shown in FIG. 1, the link 30 should be lightly stretched when positioned between the pair of lugs 28 on the closure, so that the link will remain in position in the slots 29 by virtue of the tension in the link. Then, on engaging the pivot pins 27 with the holes 19, as shown in FIGS. 2 and 3, the lug 22 on the base component 15 will engage the central part of the link 30 and strain that link so as to take up a generally V-shaped form.

With the closure 17 in its closed position, shown in FIGS. 2, 3 and 9A, the link 30 is strained to the greatest extent. Pivoting movement of the closure 17 from its closed position through an intermediate position (FIG. 9B) to its open position (FIG. 9C) reduces the straining of the link, with the included angle of the V-shaped form taken up by the main portion 31 of the link 30 reducing as the closure moves to its open position. Thus, the closure 17 will tend to move to its open position where the tension in the link 30 is at a minimum.

In FIG. 3, two retaining walls 33 are shown, disposed outside the pair of lugs 28 and spaced therefrom. These walls serve to assist holding of the link 30 in the slots 29 of lugs 28, by having each head 32 of the link a friction fit between the wall 33 and the opposed face of the link. These walls may be omitted, as shown in FIGS. 1 and 2, if the link is sufficiently strained when carried in the pair of lugs 29, before the closure is engaged with the base member.

Figure 8:
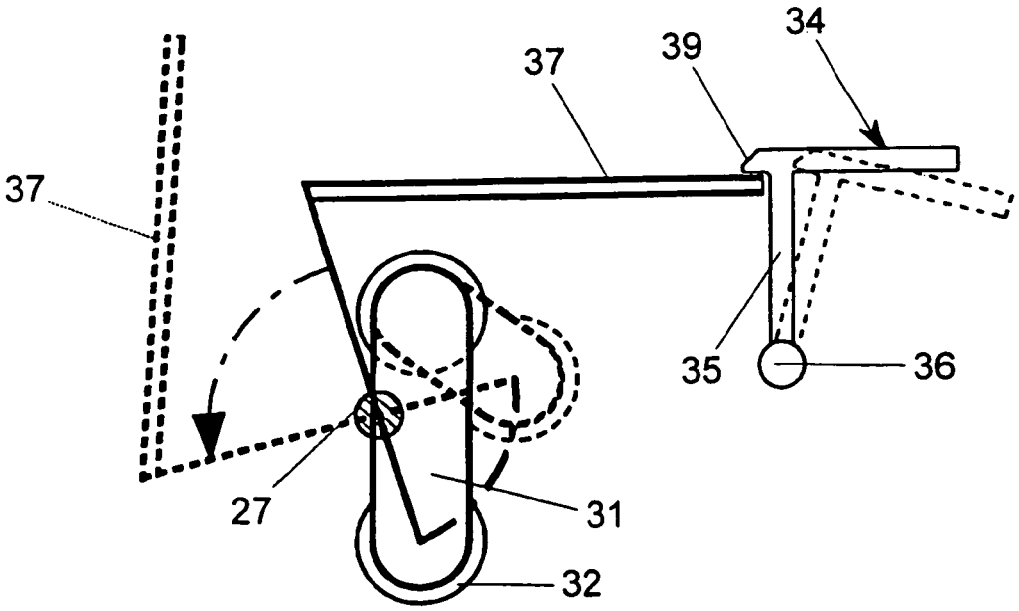
FIG. 8 shows a catch mechanism used with the first, second and third embodiments of this invention.

In order to maintain the closure 17 in its closed position, a catch mechanism 34 as shown in FIG. 8 is employed. This catch mechanism includes an L-shaped catch member 35 which is pivoted at 36 to the base component 15, so as to be movable between a holding position shown in solid lines in FIG. 8 and a released position shown in broken lines in that Figure. The closure 17 is shown diagrammatically at 37 in FIG. 8, but in the arrangement of FIGS. 1 and 2, there is a forwardly-projecting tab (not shown) on the closure 17 and below the upper surface of that closure, so that the upper surface 38 of the catch member 35 may lie in substantially the same plane as the upper surface of the closure 17.

Though in FIG. 8 a simple pivot 36 is shown for the catch member 35, preferably the pivot is defined by a moulded film hinge which will urge the catch member to its holding position, movement of the catch member to its released position being against the force provided by the film hinge. The forward edge 39 of the catch member should be raked as shown in FIG. 8, so as to permit the closure 17 (or the tab provided thereon) to ride over that edge 39, deflecting the catch member 35 as necessary. Securing of the closure 17 in its closed position thus simply requires the closure to be pushed to that position. Then, the closure may be released by a simple one-touch operation, pressing on the upper surface of the catch member 35.

Figure 4:
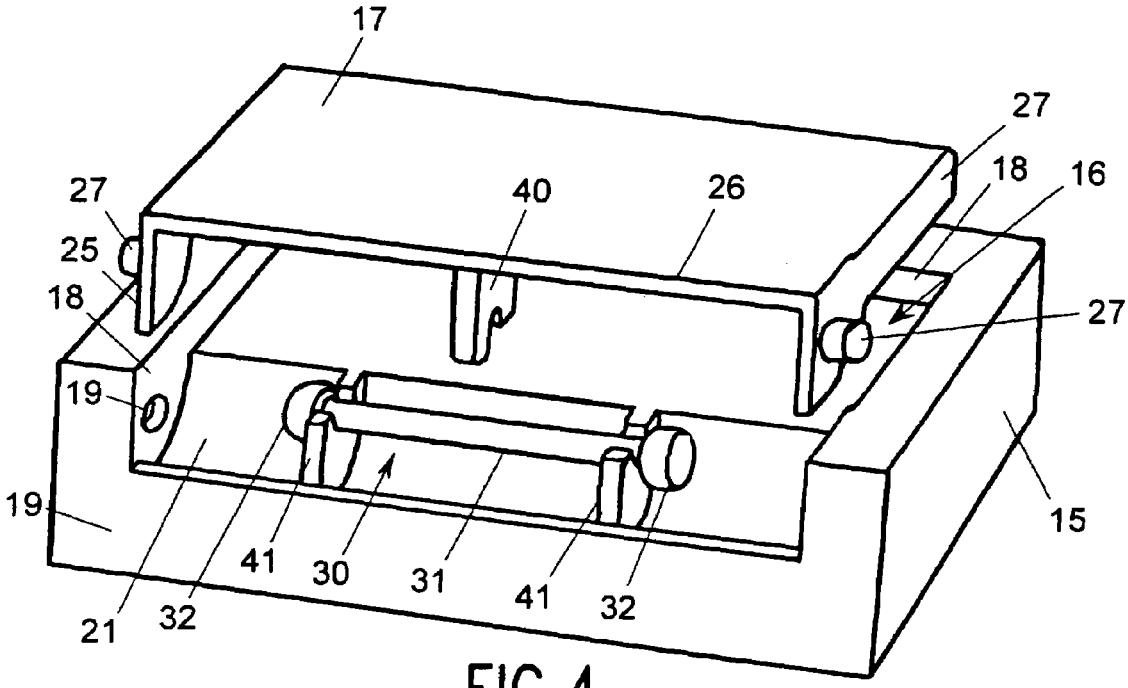
FIGS. 4, 5 and 6 correspond to FIGS. 1, 2 and 3 respectively, but showing a second embodiment.
Figure 5:
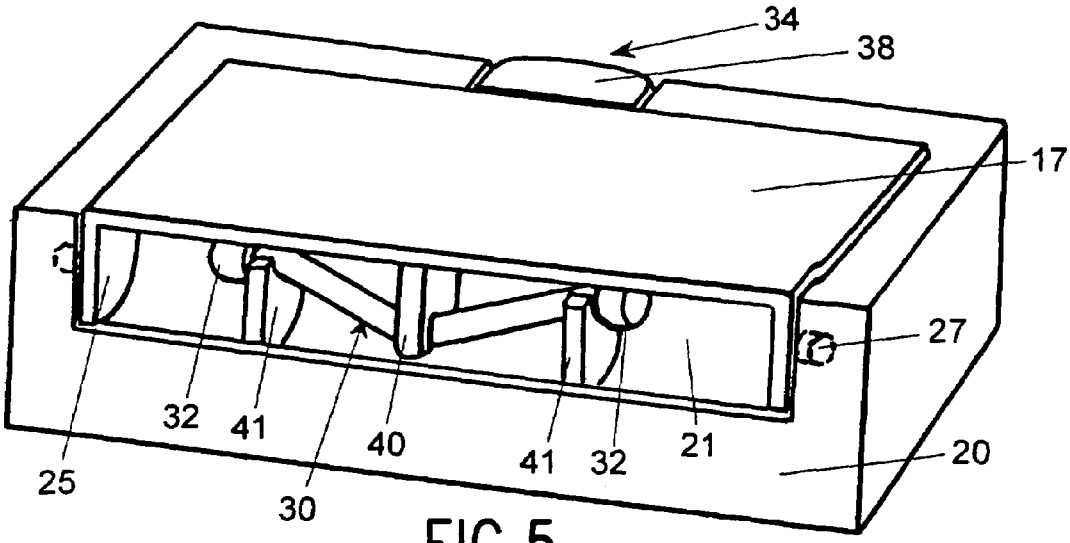
Figure 6:
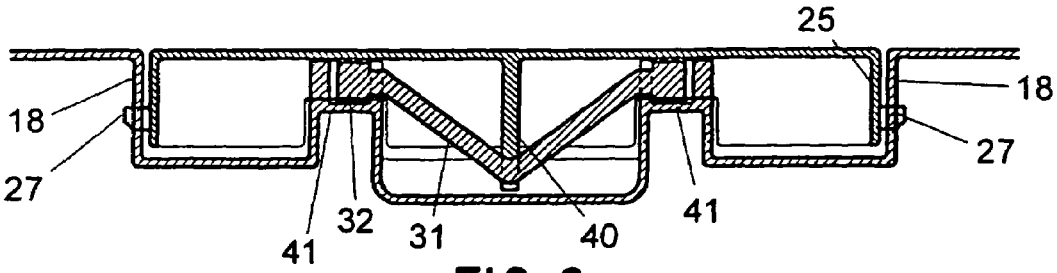

FIGS. 4, 5 and 6 show a second embodiment of this invention but which is generally similar to the arrangement of FIGS. 1 to 3. Consequently, like parts are given like reference numerals and those parts will not be described again here.

The second embodiment of FIGS. 4 to 6 differs from that of FIGS. 1 to 3 in that the closure 17 is provided with only a single downwardly-projecting lug 40, disposed centrally of the closure adjacent its rear edge 26. Conversely, the base component 15 has a pair of spaced lugs 41 the upper edges of which are on the same level as the upper edge of the curved wall 21. In this embodiment, the elastic link 30 is strained between the lugs 41 and the lug 40 on the closure engages a central region of the main portion 31 of that link, to deform the link into a generally V-shaped form when the closure is in its closed position, as shown in FIGS. 5 and 6. In other respects, the embodiment of FIGS. 4 to 6 operates as has been described above with reference to FIGS. 1 to 3.

Figure 7:
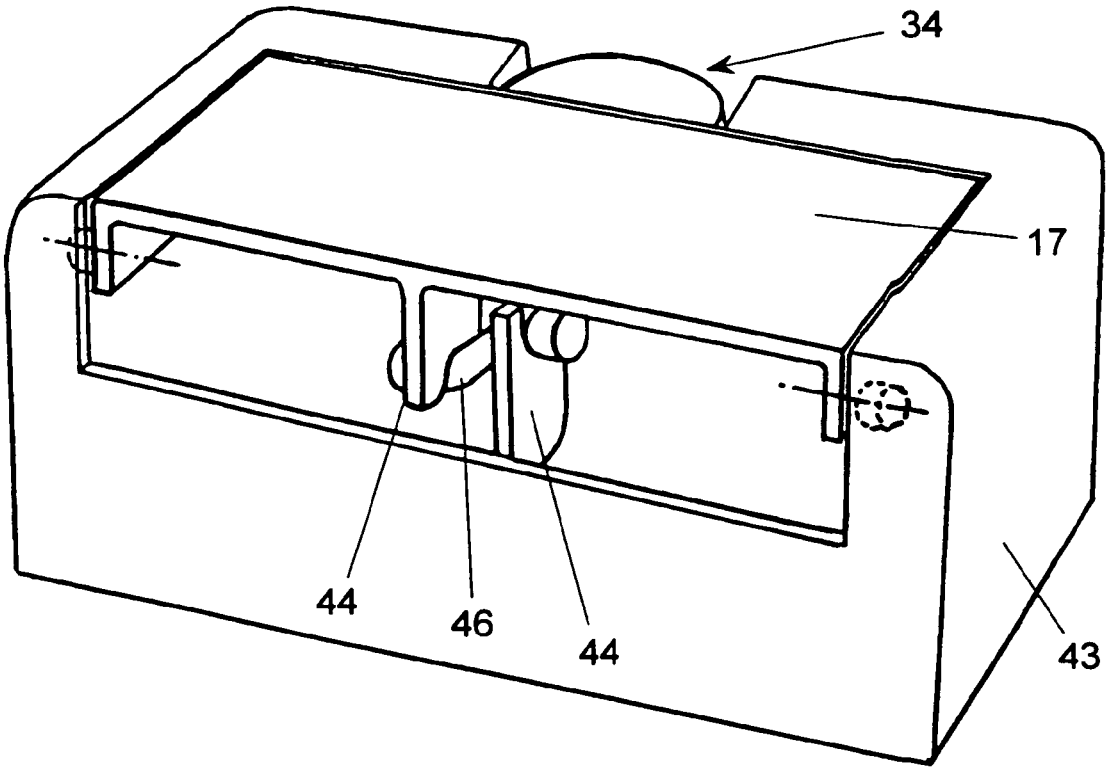
FIG. 7 corresponds generally to FIG. 2, but shows a third embodiment of this invention.

FIG. 7 shows a third embodiment of this invention. In this embodiment, the base component 43 has a generally rounded profile to enhance the aesthetic appearance thereof, as compared to the base component 15, but otherwise generally corresponds to that base component 15. However, in this embodiment both the base component 43 and the closure 17 are provided only with one lug 44 and 45 each, those lugs being disposed equally to either side of the centre line of the closure 17. A shorter elastic link 46 is provided than in the case of the embodiments of FIGS. 1 to 6, but the link is generally of the same form as link 30 and operates in the same manner. In other respects, the embodiment of FIG. 7 is essentially the same as the first two embodiments, described above.

Figure 10:
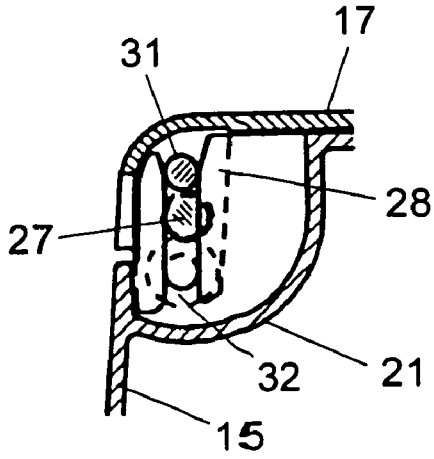
FIG. 10 is a view similar to that of FIG. 9A, but of an alternative over-centre arrangement.

It will be appreciated that with the embodiments of FIGS. 1 to 7, the axis of pivoting movement of the closure 17 (that is, the axis of the holes 19 and pivot pins 27) is disposed slightly to the rear of the slots in the lugs of the closure and base component, as shown in FIG. 9A. This ensures that the link is strained to its greatest extent when the closure is in its closed position, with the straining of the link reducing as the closure is moved to its open position. The position of said axis relative to the lugs may be adjusted to control the rate of change of the force of the link. If that axis is moved sufficiently forwardly to lie just in front of the link with the closure in its closed position, there will be imparted to the mechanism an over-centre (or toggle) action; such an arrangement is shown in FIG. 10. With this arrangement, the straining of the link increases for the first few degrees of opening movement of the closure, whereafter the action proceeds as described above, with the straining reducing until the closure is in its opened position. The result is that the closed position of the closure is stable and the closure will move automatically to its open position only after raising the closure through a few degrees. This then permits the elimination of the catch mechanism 34 whilst still giving a simple and easy to operate one-touch action, of just raising the closure by a few degrees at its forward edge.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising a bottom, a top said top comprising an opening, and four side walls depending from said top and connecting said top with said bottom, said container further comprising a moveable lid hingedly attached at a hinging axis to said top for movement between closed and open positions over said opening, a catch mechanism for maintaining said closure in said closed position, a catch member disposed on said top generally opposite the region of the hinging axis of said lid said catch member when depressed releasing said catch mechanism, juxtaposed lugs provided respectively on said top and said lid in the region of the hinging axis of said lid, each lug having at or adjacent its free end a receptor, and an elastic link located in and extending between said receptors of said lugs, said receptors of said lugs being arranged such that said elastic link is strained when said lid is at its closed position, the straining of said elastic link varying as said lid is moved between its closed and open positions wherein said variation in strain moves said lid from said closed position to said open position upon depression of said catch member and corresponding release of said catch mechanism.

2. A container comprising a bottom, a top said top comprising an opening, and four side walls depending from said top and connecting said top with said bottom, said container further comprising a moveable lid hingedly attached at a hinging axis to said top for movement between closed and open positions over said opening, a catch mechanism for maintaining said closure in said closed position, a catch member disposed on said top generally opposite the region of the hinging axis of said lid said catch member when depressed releasing said catch mechanism, juxtaposed lugs provided respectively on said top and said lid in the region of the hinging axis of said lid, each lug having at or adjacent its free end a receptor, and an elastic link, comprised of an elastomeric material, located in and extending between said receptors of said lugs, said receptors of said lugs being arranged such that said elastic link is strained when said lid is at its closed position, the straining of said elastic link varying as said lid is moved between its closed and open positions wherein said variation in strain moves said lid from said closed position to said open position upon depression of said catch member and corresponding release of said catch mechanism.

3. The container of claim 1 wherein said side walls, said top, and said bottom are dimensioned such that said container exhibits a stable configuration, such catch member may be depressed and said catch mechanism released with one hand without need to further stabilize said container.

* * * * *